US011764513B2

(12) United States Patent
Lin et al.

(10) Patent No.: US 11,764,513 B2
(45) Date of Patent: Sep. 19, 2023

(54) ELECTRICAL CONNECTOR AND TRANSMISSION WAFER THEREOF

(71) Applicant: STARCONN ELECTRONIC (Su Zhou) Co., LTD, Kunshan (CN)

(72) Inventors: San-Yo Lin, New Taipei (TW); Fu Su, Kunshan (CN); Mao-Shan Chen, Kunshan (CN)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 351 days.

(21) Appl. No.: 17/342,547

(22) Filed: Jun. 9, 2021

(65) Prior Publication Data

US 2022/0102902 A1 Mar. 31, 2022

(30) Foreign Application Priority Data

Sep. 28, 2020 (CN) ..... 202011041838.7

(51) Int. Cl.

| | |
|---|---|
| ***H01R 13/648*** | (2006.01) |
| ***H01R 13/514*** | (2006.01) |
| ***H01R 13/6471*** | (2011.01) |
| ***H01R 13/6586*** | (2011.01) |
| ***H01R 13/518*** | (2006.01) |

(52) U.S. Cl.

CPC ..... *H01R 13/514* (2013.01); *H01R 13/518* (2013.01); *H01R 13/6471* (2013.01); *H01R 13/6586* (2013.01)

(58) Field of Classification Search

CPC .. H01R 13/514; H01R 13/516; H01R 13/518; H01R 13/6471; H01R 13/6581; H01R 13/6585; H01R 13/6586; H01R 13/6587

USPC ..... 439/607.08

See application file for complete search history.

(56) References Cited

U.S. PATENT DOCUMENTS

| | | | | |
|---|---|---|---|---|
| 5,664,968 | A * | 9/1997 | Mickievicz | H01R 13/6582 439/607.1 |
| 8,905,786 | B2 * | 12/2014 | Davis | H01R 13/6587 439/607.1 |
| 9,548,570 | B2 * | 1/2017 | Laurx | H01R 12/737 |
| 10,644,453 | B2 * | 5/2020 | Laurx | H01R 13/6461 |
| 10,790,620 | B2 * | 9/2020 | Yuan | H01R 13/6585 |
| 2015/0303618 | A1 * | 10/2015 | Lee | H01R 13/506 439/607.05 |

(Continued)

*Primary Examiner* — Khiem M Nguyen

(74) *Attorney, Agent, or Firm* — Li & Cai Intellectual Property Office

(57) ABSTRACT

An electrical connector and a transmission wafer thereof are provided. The transmission wafer includes an insulating frame, a plurality of signal terminals and ground terminals fixed on the insulating frame, and a shielding sheet that is assembled to the insulating frame. Each of the signal terminals includes a signal contacting segment protruding from the insulating frame. Each of the ground terminals includes a ground contacting segment having a ground contact and protruding from the insulating frame. The shielding sheet includes a sheet body and a plurality of outer fixing arms extending from the sheet body. Each of the outer fixing arms corresponds in position to one of the ground contacting segments along a first direction. A free end portion of each of the outer fixing arms protrudes from the ground contact of the corresponding ground contacting segment along an insertion direction that is perpendicular to the first direction.

20 Claims, 14 Drawing Sheets

(56) References Cited

U.S. PATENT DOCUMENTS

| | | | | |
|---|---|---|---|---|
| 2016/0322760 | A1* | 11/2016 | Long | H01R 12/724 |
| 2018/0166828 | A1* | 6/2018 | Gailus | H01R 12/00 |
| 2019/0044284 | A1* | 2/2019 | Dunham | H01R 12/716 |

* cited by examiner

ELECTRICAL CONNECTOR AND TRANSMISSION WAFER THEREOF

CROSS-REFERENCE TO RELATED PATENT APPLICATION

This application claims the benefit of priority to China Patent Application No. 202011041838.7, filed on Sep. 28, 2020 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to an electrical connector and a transmission wafer thereof for being used to transmit a signal in high speed.

BACKGROUND OF THE DISCLOSURE

A conventional electrical connector used to transmit a signal in high speed includes an insulating outer case and a plurality of transmission wafers that are inserted to the insulating outer case and substantially stacked with each other. However, the structure of the conventional electrical connector is gradually limited to an existing design configuration, so that the structure of the conventional electrical connector is difficult to be further improved.

SUMMARY OF THE DISCLOSURE

In response to the above-referenced technical inadequacies, the present disclosure provides an electrical connector and a transmission wafer thereof to effectively improve on the issues associated with conventional electrical connectors.

In one aspect, the present disclosure provides an electrical connector, which includes a housing and a plurality of transmission wafers. The housing includes an insulating outer case and a conductive inner case that is disposed in the insulating outer case. The insulating outer case has a plurality of terminal slots penetrating therethrough along an insertion direction. The transmission wafers are arranged along a first direction perpendicular to the insertion direction and are inserted into the housing. Any one of the transmission wafers includes an insulating frame, a plurality of signal terminals, a plurality of ground terminals, and a shielding sheet. Each of the signal terminals includes a signal embedded segment embedded in the insulating frame and a signal contacting segment that extends from the signal embedded segment to protrude from the insulating frame. Each of the ground terminals includes a ground embedded segment embedded in the insulating frame and a ground contacting segment that extends from the ground embedded segment to protrude from the insulating frame. Each of the ground contacting segments has a ground contact, and the ground contacting segments and the signal contacting segments are arranged in one row along a second direction that is perpendicular to the insertion direction and the first direction. The shielding sheet is assembled to the insulating frame and includes a sheet body and a plurality of outer fixing arms that extend from the sheet body. The outer fixing arms are arranged in another row along the second direction, and each of the outer fixing arms corresponds in position to one of the ground contacting segments along the first direction. A free end portion of each of the outer fixing arms protrudes from the ground contact of the corresponding ground contacting segment along the insertion direction, and each of the outer fixing arms and the corresponding ground contacting segment are inserted into and fixed with the conductive inner case. The signal contacting segments and the ground contacting segments of the transmission wafers are respectively arranged in the terminal slots of the housing.

In certain embodiments, the free end portion of each of the outer fixing arms protrudes from the ground contact of the corresponding ground contacting segment along the insertion direction by at least 0.5 mm.

In certain embodiments, the outer fixing arms of the transmission wafers are inserted into and fixed with the conductive inner case through the free end portions thereof.

In certain embodiments, the ground contacts and the free end portions of the transmission wafers are electrically coupled to each other by being inserted into and fixed with the conductive inner case.

In certain embodiments, the conductive inner case is an electro-plated plastic inner case, a conductive plastic inner case, or a metallic inner case.

In certain embodiments, the free end portion of each of the outer fixing arms and the ground contact of the corresponding ground contacting segment are spaced apart from each other along the first direction by the conductive inner case.

In certain embodiments, the insulating outer case has an outer matching surface and an inner assembling surface, and the terminal slots are formed by penetrating from the outer matching surface to the inner assembling surface. The conductive inner case has a connection surface arranged away from the outer matching surface, the free end portions of the outer fixing arms and the ground contacting segments of the transmission wafers are inserted into and fixed with the connection surface of the conductive inner case so as to be electrically coupled to each other, and the connection surface and the inner assembling surface have a step difference therebetween along the insertion direction.

In certain embodiments, the conductive inner case has a plurality of windows in spatial communication with the terminal slots, and a quantity of the windows is less than a quantity of the terminal slots. Two of the signal contacting segments of any one of the transmission wafers adjacent to each other are arranged in one of the windows of the conductive inner case.

In certain embodiments, in any one of the transmission wafers, a quantity of the outer fixing arms of the shielding sheet is equal to a quantity of the ground terminals, and the free end portion of each of the outer fixing arms does not protrude beyond a distal end of the corresponding ground contacting segment along the insertion direction.

In certain embodiments, the free end portion of each of the outer fixing arms has at least one interference region, and the free end portion of each of the outer fixing arms is fixed to the conductive inner case through the at least one interference region thereof.

In another aspect, the present disclosure provides a transmission wafer of an electrical connector, which includes an insulating frame, a plurality of signal terminals, a plurality of ground terminals, and a shielding sheet. Each of the signal terminals includes a signal embedded segment embedded in the insulating frame and a signal contacting segment that extends from the signal embedded segment to protrude from the insulating frame. Each of the ground terminals includes a ground embedded segment embedded in the insulating frame and a ground contacting segment that extends from the ground embedded segment to protrude from the insulating frame. Each of the ground contacting segments has a ground contact. The shielding sheet is assembled to the insulating frame and includes a sheet body and a plurality of outer fixing arms that extend from the sheet body. Each of the outer fixing arms corresponds in position to one of the ground contacting segments along a first direction. The ground contacting segments and the signal contacting segments are arranged in one row along a second direction that is perpendicular to the first direction, and the outer fixing arms are arranged in another row along the second direction. A free end portion of each of the outer fixing arms protrudes beyond the ground contact of the corresponding ground contacting segment along an insertion direction that is perpendicular to the first direction and the second direction.

Therefore, any one of the transmission wafers of the present disclosure is provided in a new structure different from conventional transmission wafers (e.g., the ground contacting segments and the signal contacting segments are arranged in one row, and the outer fixing arms are arranged in another row; and each of the free end portions protrudes beyond the corresponding ground contact), thereby expanding space in the follow-up research and design of the electrical connector (or the transmission wafer).

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
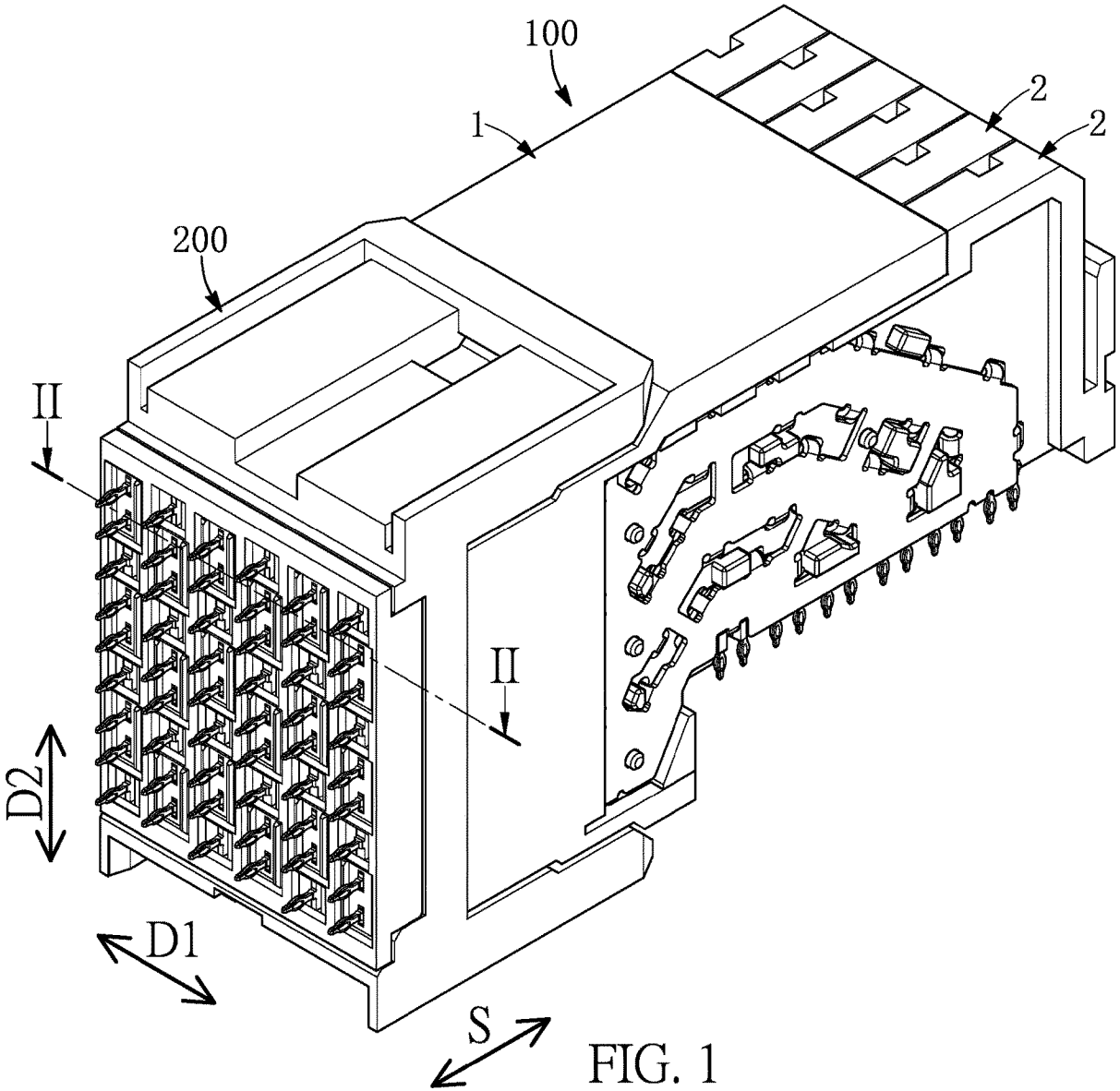
FIG. 1 is a perspective view showing an electrical connector assembled to a matching connector according to an embodiment of the present disclosure.
Figure 2:
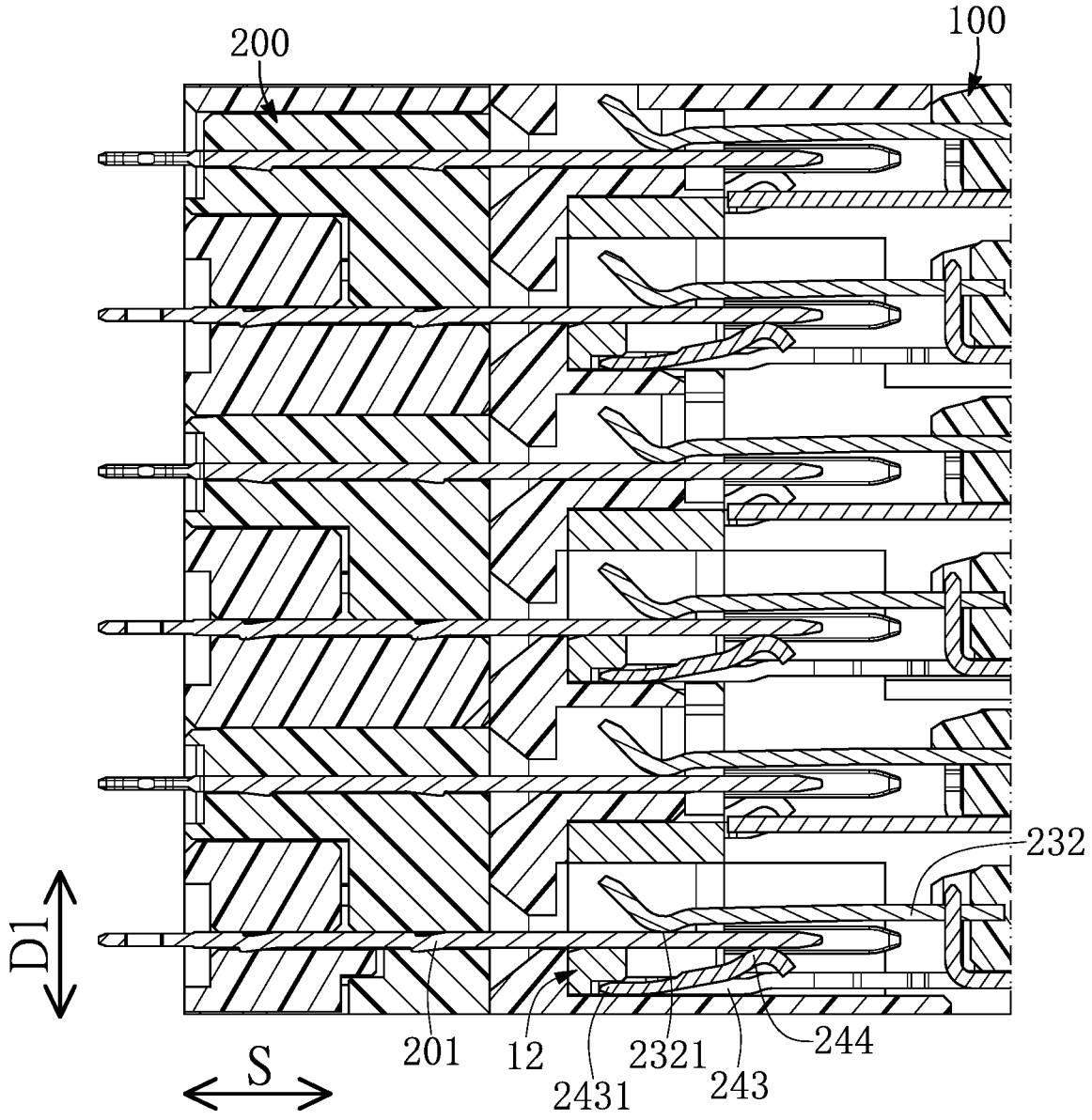
FIG. 2 is a cross-sectional view taken along line II-II of FIG. 1.
Figure 3:
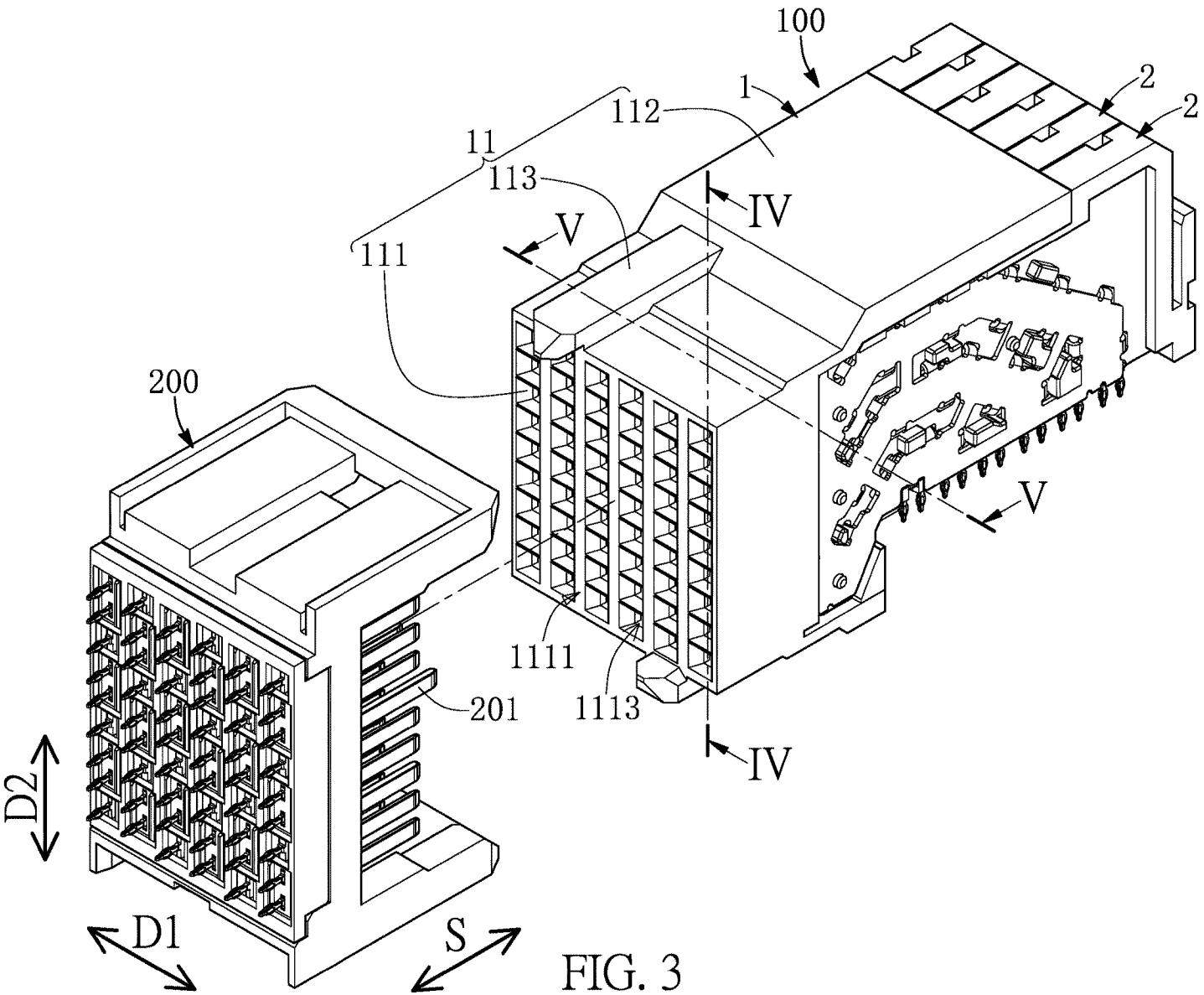
FIG. 3 is an exploded view of FIG. 1.
Figure 4:
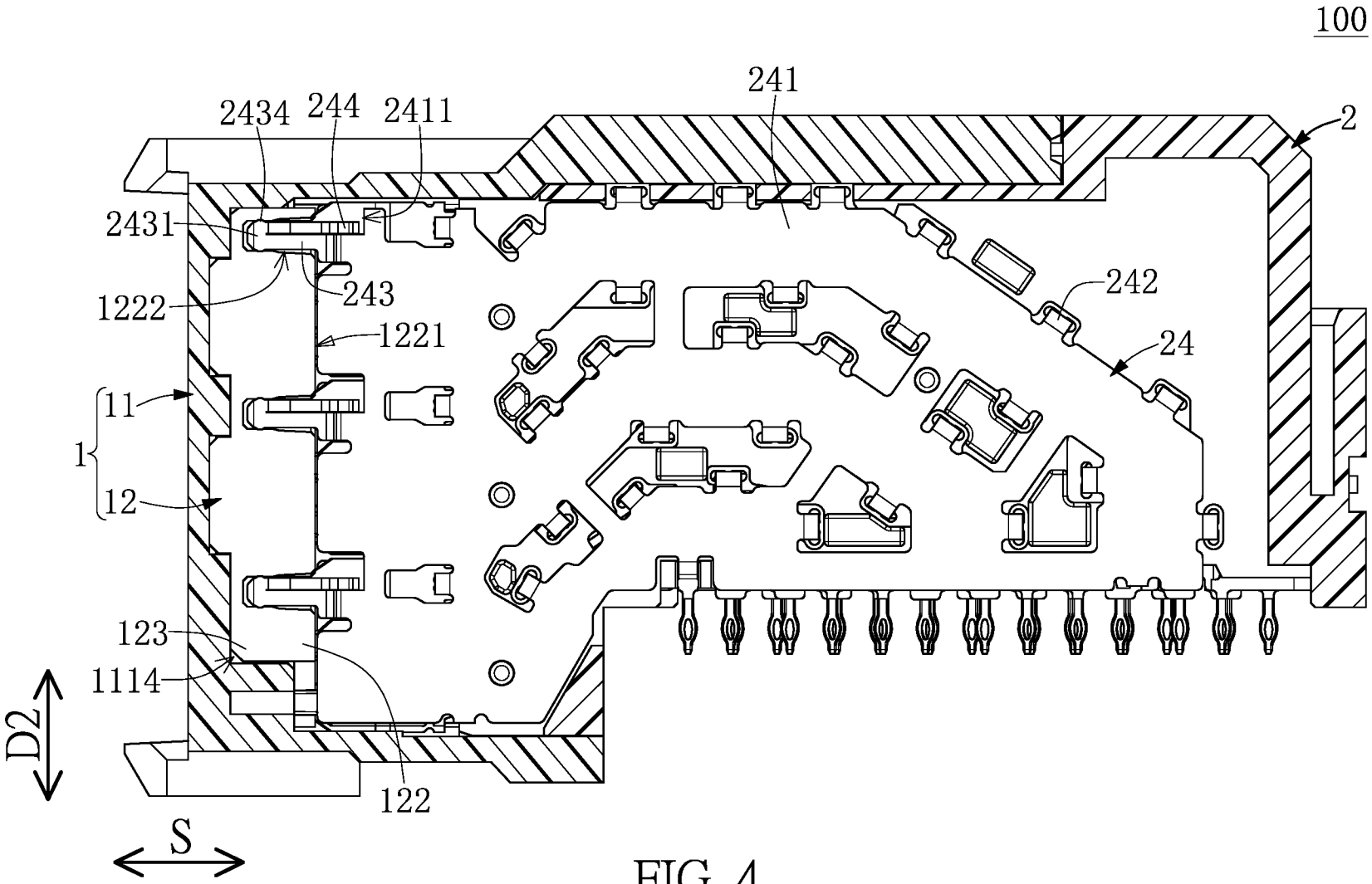
FIG. 4 is a cross-sectional view taken along line IV-IV of FIG. 3.
Figure 5:
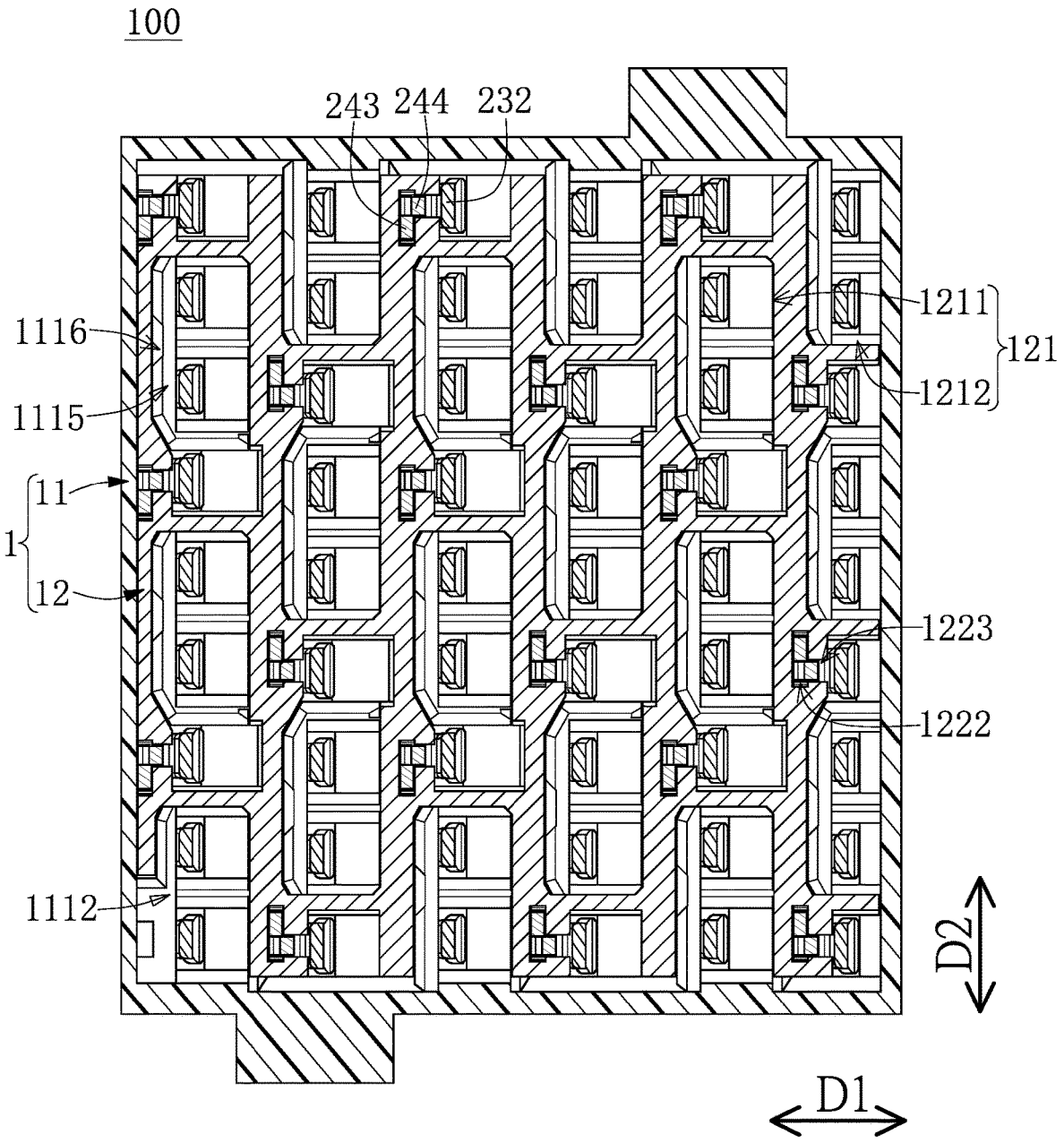
FIG. 5 is a cross-sectional view taken along line V-V of FIG. 3.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 14, an embodiment of the present disclosure provides an electrical connector 100. As shown in FIG. 1 to FIG. 5, the electrical connector 100 is provided for being inserted into a matching connector 200 along an insertion direction S, and is a high-speed (or high-frequency) connector applied to a server or a switch, but the present disclosure is not limited thereto. In order to clearly describe the present embodiment, the electrical connector 100 defines a first direction D1 and a second direction D2 that is perpendicular to the first direction D1, and any one of the first direction D1 and the second direction D2 is perpendicular to the insertion direction S.

Figure 6:
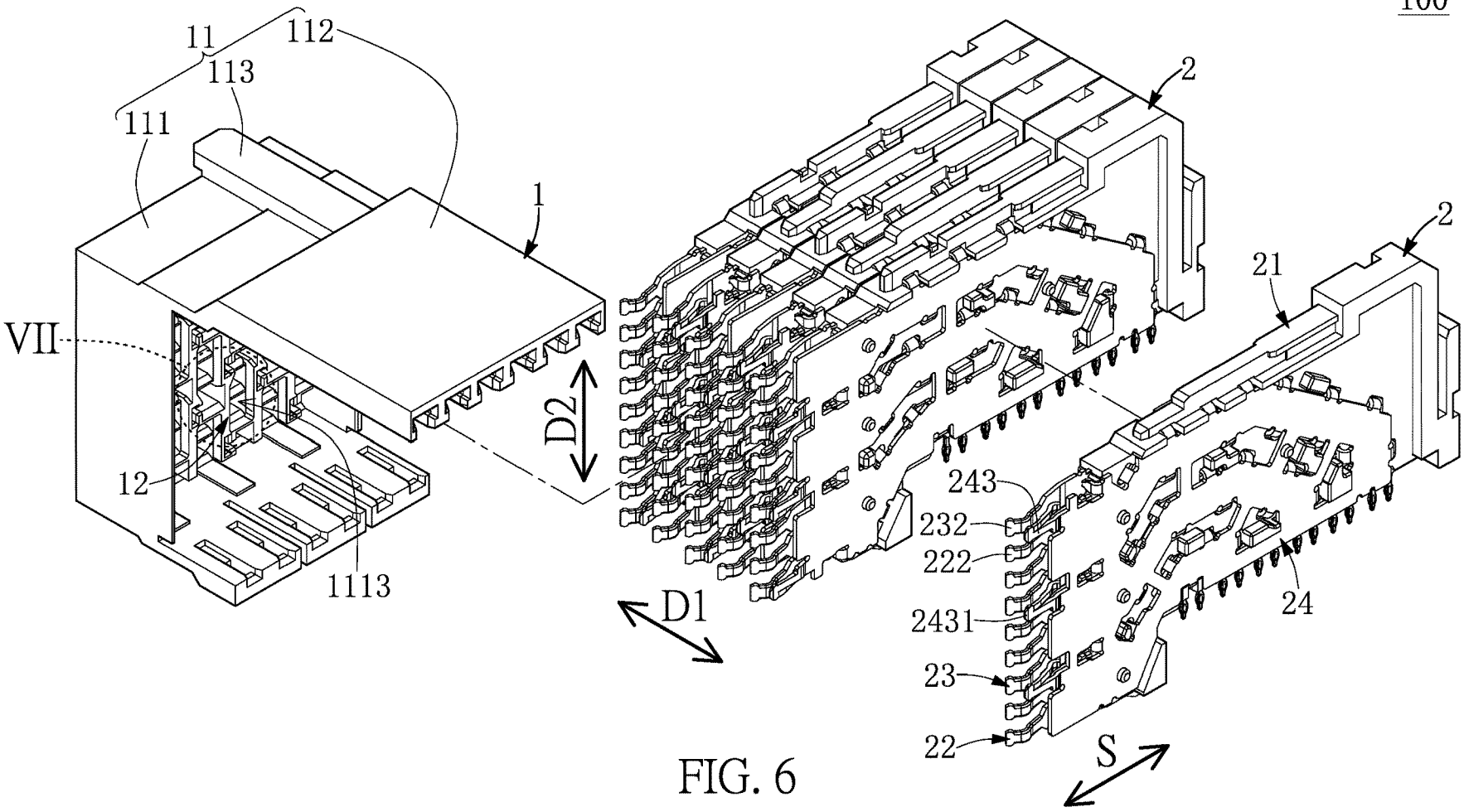
FIG. 6 is an exploded view of the electrical connector according to the embodiment of the present disclosure.
Figure 7:
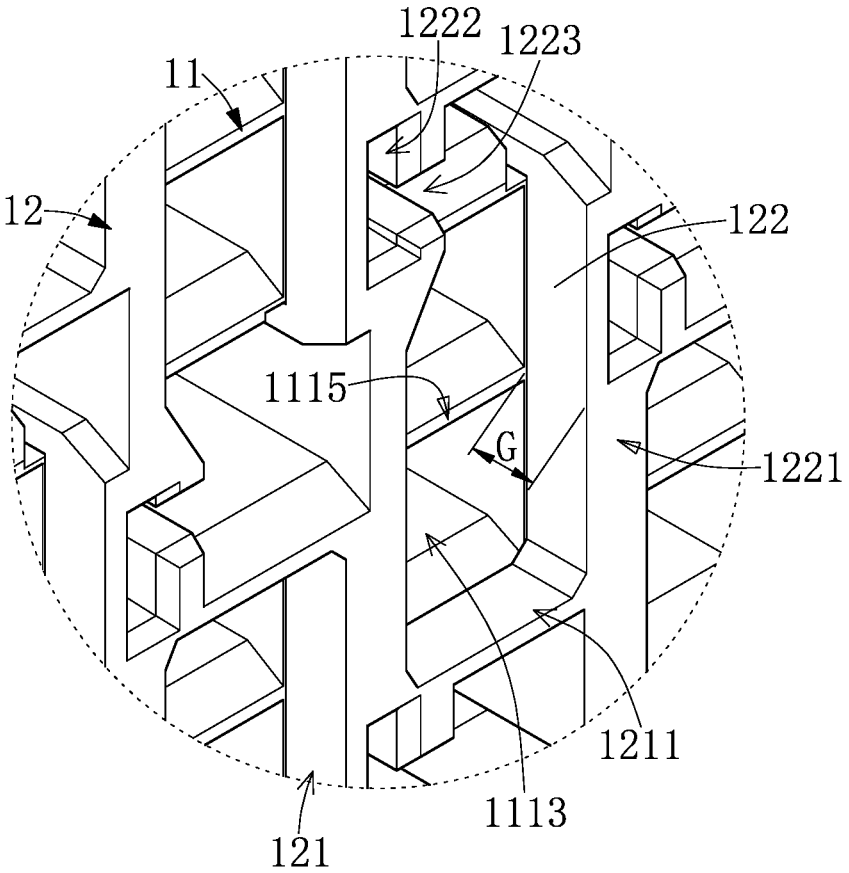
FIG. 7 is an enlarged view showing portion VII of FIG. 6.
Figure 8:
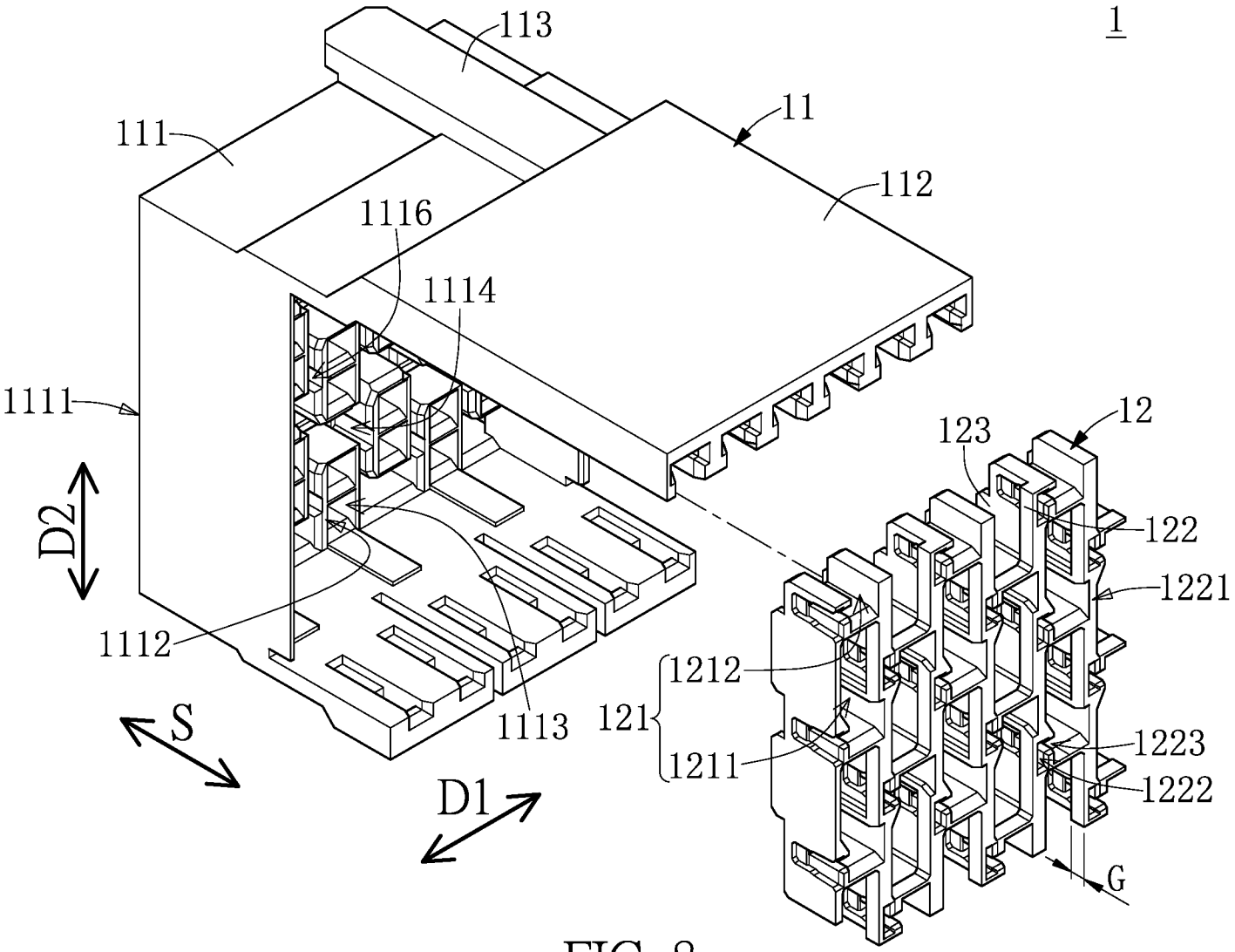
FIG. 8 is an exploded view of a housing of the electrical connector of FIG. 6.

As shown in FIG. 6 to FIG. 8, the electrical connector 100 includes a housing 1 and a plurality of transmission wafers 2 that are inserted into the housing 1 along the insertion direction S. Moreover, the transmission wafers 2 in the present embodiment are arranged along the first direction D1. It should be noted that the transmission wafer 2 in the present embodiment is described in cooperation with the housing 1, but the present disclosure is not limited thereto. For example, in other embodiments of the present disclosure, the transmission wafer 2 can be independently used (e.g., sold) or can be used in cooperation with other components.

The housing 1 in the present embodiment includes an insulating outer case 11 and a conductive inner case 12 that is disposed in the insulating outer case 11. The insulating outer case 11 and the conductive inner case 12 can be a signal one-piece structure or can be two separated structures according to design requirements, and the present disclosure is not limited thereto. It should be noted that any housing without having a conductive inner case is different from the housing 1 disclosed in the present embodiment.

The insulating outer case 11 includes an insertion portion 111 in a substantially cuboid shape, a positioning board 112 extending from a top end of the insertion portion 11 along the insertion direction S, and a plurality of guiding columns 113 that are staggeredly arranged on a top surface and a bottom surface of the insertion portion 111. The positioning board 112 is used to engage with and to fix the transmission wafers 2 in position, and the guiding columns 113 are used to align with the matching connector 200. A quantity of the guiding columns 113 in the present embodiment is two, but the present disclosure is not limited thereto.

Figure 9:
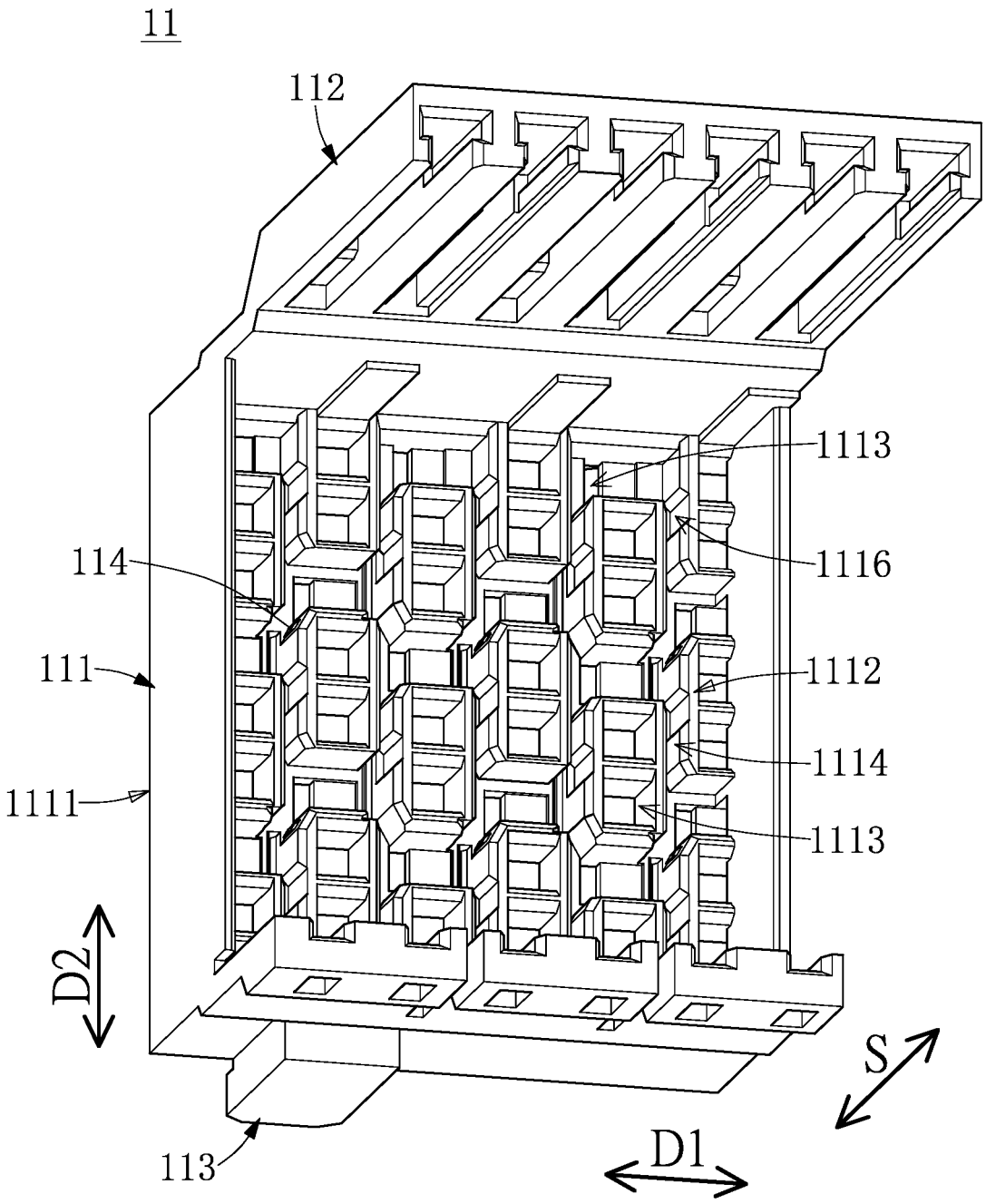
FIG. 9 is a perspective view showing an insulating outer case of the housing of FIG. 8 from another angle of viewing.

As shown in FIG. 8 and FIG. 9, the insertion portion 111 of the insulating outer case 11 has an outer matching surface 1111 and an inner assembling surface 1112. The outer matching surface 1111 is farther away from the positioning board 112 than the inner assembling surface 1112. The insulating outer case 11 has a plurality of terminal slots 1113 penetrating through the insertion portion 111 along the insertion direction S. The terminal slots 1113 are in a matrix arrangement, and the terminal slots 1113 in the present embodiment are formed by penetrating from the outer matching surface 1111 to the inner assembling surface 1112 along the insertion direction S. The insulating outer case 11 further has an inner assembling slot 1114 recessed in the inner assembling surface 1112 and being in spatial communication with a part of the terminal slots 1113.

As shown in FIG. 7 and FIG. 8, the conductive inner case 12 in the present embodiment can be chosen from an electro-plated plastic inner case, a conductive plastic inner case, or a metallic inner case according to design requirements. Moreover, the metallic inner case can be formed in a metal injection molding manner or a powder metallurgy manner, but the present disclosure is not limited thereto. The conductive inner case 12 in the present embodiment has a plurality of windows 121 extending therethrough defined by vertical framepieces and horizontal framepieces. The windows 121 are in spatial communication with the terminal slots 1113, and a quantity of the windows 121 is less than a quantity of the terminal slots 1113.

Specifically, the conductive inner case 12 in the present embodiment is in a substantially fence shape, the windows 121 are staggeredly arranged along the first direction D1, and the windows 121 are arranged in a plurality of rows each parallel to the second direction D2. The windows 121 in the present embodiment include a plurality of enclosed windows 1211 and a plurality of open windows 1212 that are arranged on a peripheral portion of the conductive inner case 12. In other words, the open windows 1212 surround the enclosed windows 1211.

Moreover, each of the enclosed windows 1211 is in spatial communication with at least two of the terminal slots 1113, each of the open windows 1212 is in spatial communication with at least one of the terminal slots 1113, and a quantity of the terminal slots 1113 in spatial communication with any one of the enclosed windows 1211 is greater than or equal to a quantity of the terminal slots 1113 in spatial communication with any one of the open windows 1212. In the present embodiment, each of the enclosed windows 1211 is in spatial communication with three of the terminal slots 1113 that are arranged along the second direction D2 and that are adjacent to each other within the same row of the terminal slots 1113. Moreover, any one of the open windows 1212 is in spatial communication with one of the terminal slots 1113, or is in spatial communication with two or three of the terminal slots 1113 that are arranged along the second direction D2 and that are adjacent to each other within the same row of the terminal slots 1113.

Specifically, the conductive inner case 12 has an exposed portion 122 and an embedded portion 123. The conductive inner case 12 is inserted into and fixed with the inner assembling slot 1114 through the embedded portion 123. In other words, the exposed portion 122 protrudes from the inner assembling slot 1114 (and/or the inner assembling surface 1112). The embedded portion 123 and the inner assembling slot 1114 can be fixed with each other in an interference manner, thereby firmly assembling the conductive inner case 12 to the insulating outer case 11.

As shown in FIG. 7 to FIG. 9, the housing 1 has a plurality of interference ribs 114 formed in the insertion portion 111 of the insulating outer case 11. The position and shape of the interference ribs 114 can be changed or adjusted according to design requirements, so that the conductive inner case 12 can be detachably fixed in the insulating outer case 11 through the interference ribs 114, but the present disclosure is not limited thereto. For example, in other embodiments of the present disclosure, the interference ribs 114 can be formed on the embedded portion 123 of the conductive inner case 12.

Moreover, the conductive inner case 12 has a connection surface 1221 arranged away from the outer matching surface 1111, and the connection surface 1221 is arranged on the exposed portion 122 and is arranged away from the embedded portion 123. The connection surface 1221 and the inner assembling surface 1112 have a step difference G therebetween along the insertion direction S. Therefore, the connection surface 1221 is not coplanar with the inner assembling surface 1112, and the connection surface 1221 protrudes from the inner assembling surface 1112. The step difference G in the present embodiment is at least 5 mm, but the present disclosure is not limited thereto. Accordingly, characteristic impedance of the electrical connector 100 can be effectively optimized by forming the step difference G between the connection surface 1221 and the inner assembling surface 1112.

Specifically, the conductive inner case 12 has a plurality of connection slots 1222 recessed in the connection surface 1221 and electrically coupled to each other. The connection slots 1222 are spaced apart from each other, and each of the connection slots 1222 can correspond in position to a corner of one of the windows 121. The position of any one of the interference ribs 114 is preferably arranged adjacent to one of the connection slots 1222. In other words, each of the interference ribs 114 is arranged in a part of the insertion portion 111 of the insulating outer case 11 that corresponds in position to a corner of one of the windows 121 (e.g., parts of the insertion portion 111 of the insulating outer case 11 correspond in position to an upper right corner and a lower left corner of each of the windows 121 and each can be provided with one of the interference ribs 114 therein), and the corners corresponding in position to the interference ribs 114 can be arranged in a plurality of columns or rows along (or parallel to) the same direction, but the present disclosure is not limited thereto. For example, in other embodiments of the present disclosure, two diagonal corners of each of the windows 121 respectively correspond in position to two of the interference ribs 114 (e.g., any one of an upper right corner and a lower left corner of each of the windows 121 can be provided with one of the interference ribs 114). Any one of the connection slots 1222 in the present embodiment is recessed from the exposed portion 122 to the embedded portion 123 and has a communication opening 1223, thereby being in spatial communication with the corresponding window 121 along the first direction D1.

A projection region defined by orthogonally projecting the conductive inner case 12 onto the inner assembling surface 1112 along the insertion direction S is overlapped with 30% to 50% of the inner assembling surface 1112. In other words, the inner assembling surface 1112 has a plurality of exposed regions 1115 without being overlapped by the projection region. Moreover, the exposed regions 1115 are portions of the inner assembling surface 1112 without being formed with the inner assembling slot 1114.

Each of the exposed regions 1115 corresponds in position to two of the terminal slots 1113 arranged along the second direction D2 and adjacent to each other within the same row of the terminal slots 1113, and is arranged in one of the windows 121. In other words, any one of the exposed regions 1115 of the present embodiment is not across two of the windows 121. Specifically, any one of the exposed regions 1115 of the inner assembling surface 1112 has a valley 1116 recessed therein along the insertion direction S and having a length of at least 0.5 mm in the second direction D2. In other words, at least one edge of the valley 1116 has the length of at least 0.5 mm in the second direction D2. An end surface of the valley 1116 (arranged on the corresponding exposed region 1115 of the inner assembling surface 1112) can be in a shape that is rectangle or trapezoid. Two edges of the valley 1116 parallel to the second direction D2 can have the same or different length. In more detail, the end surface of the valley 1116 is in a trapezoid shape, one of the two edges of the valley 1116 parallel to the second direction D2 and having a shorter length can be arranged adjacent to the corresponding terminal slot 1113 (or can be arranged away from the corresponding window 121), but the present disclosure is not limited thereto. Accordingly, characteristic impedance of the electrical connector 100 can be effectively optimized by forming the valleys 1116 recessed from the exposed regions 1115 of the inner assembling surface 1112 along the insertion direction S.

It should be noted that the insulating outer case 11 and the conductive inner case 12 in the present embodiment are provided having the above features, but any one of the insulating outer case 11 and the conductive inner case 12 can be provided with a part of the above features according to design requirements. For example, in other embodiments of the present disclosure, any one of the exposed regions 1115 of the insulating outer case 11 can be formed without the valley 1116; or, the conductive inner case 12 can be formed without the windows 121; or, the connection surface 1221 of the conductive inner case 12 and the inner assembling surface 1112 can be provided without the step difference G therebetween; or, the housing 1 can be formed without the interference ribs 114.

As shown in FIG. 6, the transmission wafers 2 are inserted into the housing 1 along the insertion direction S, and are engaged with the positioning board 112 of the insulating outer case 11. As the transmission wafers 2 in the present embodiment include two types that are of the substantially same structural configuration, the following description discloses the structure of just one of the transmission wafers 2 for the sake of brevity, but the present disclosure is not limited thereto. For example, in other embodiments of the present disclosure, the transmission wafers 2 of the electrical connector 100 can be of different structural configuration.

Figure 10:
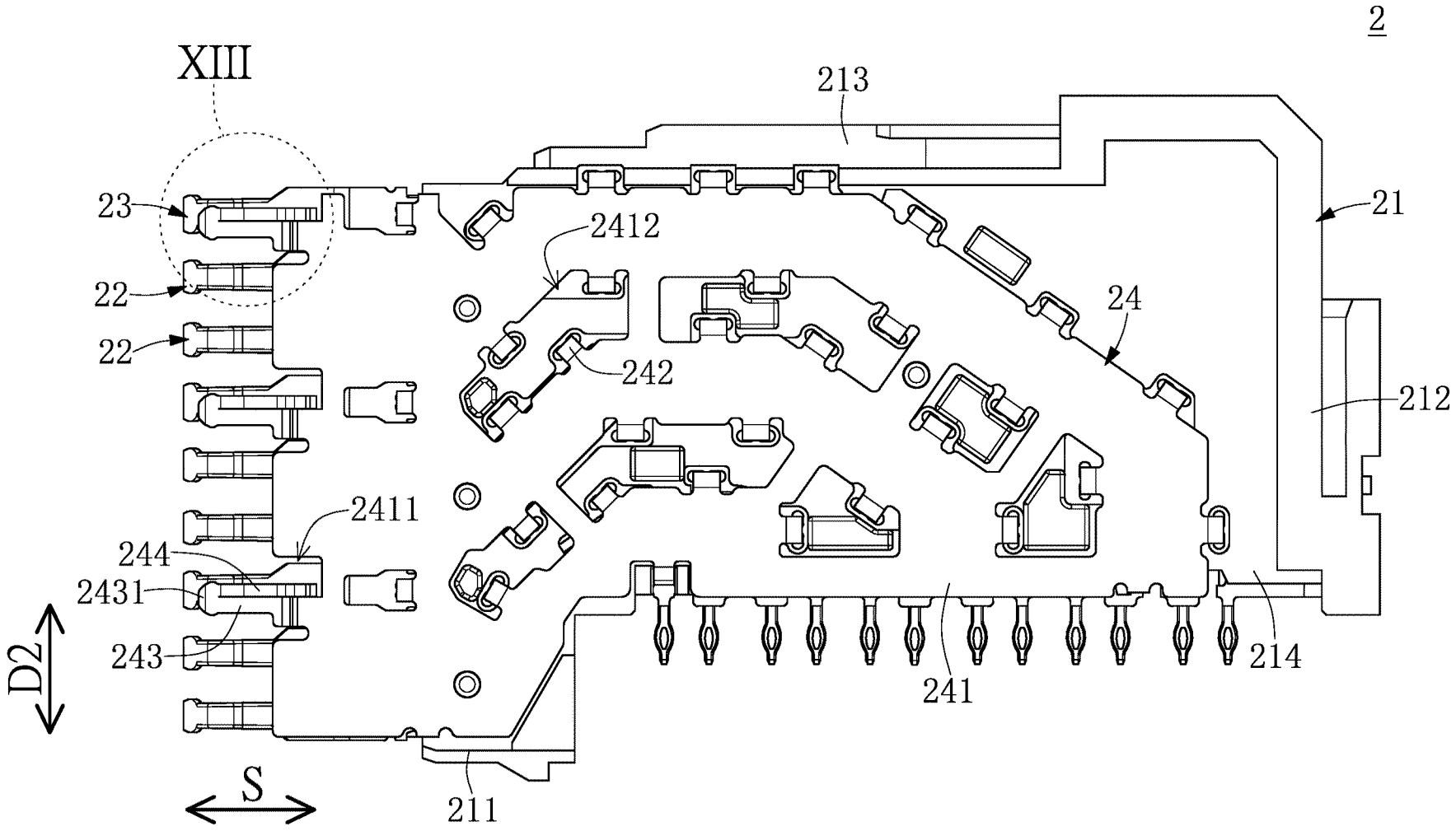
FIG. 10 is a planar view of a transmission wafer according to the embodiment of the present disclosure.
Figure 11:
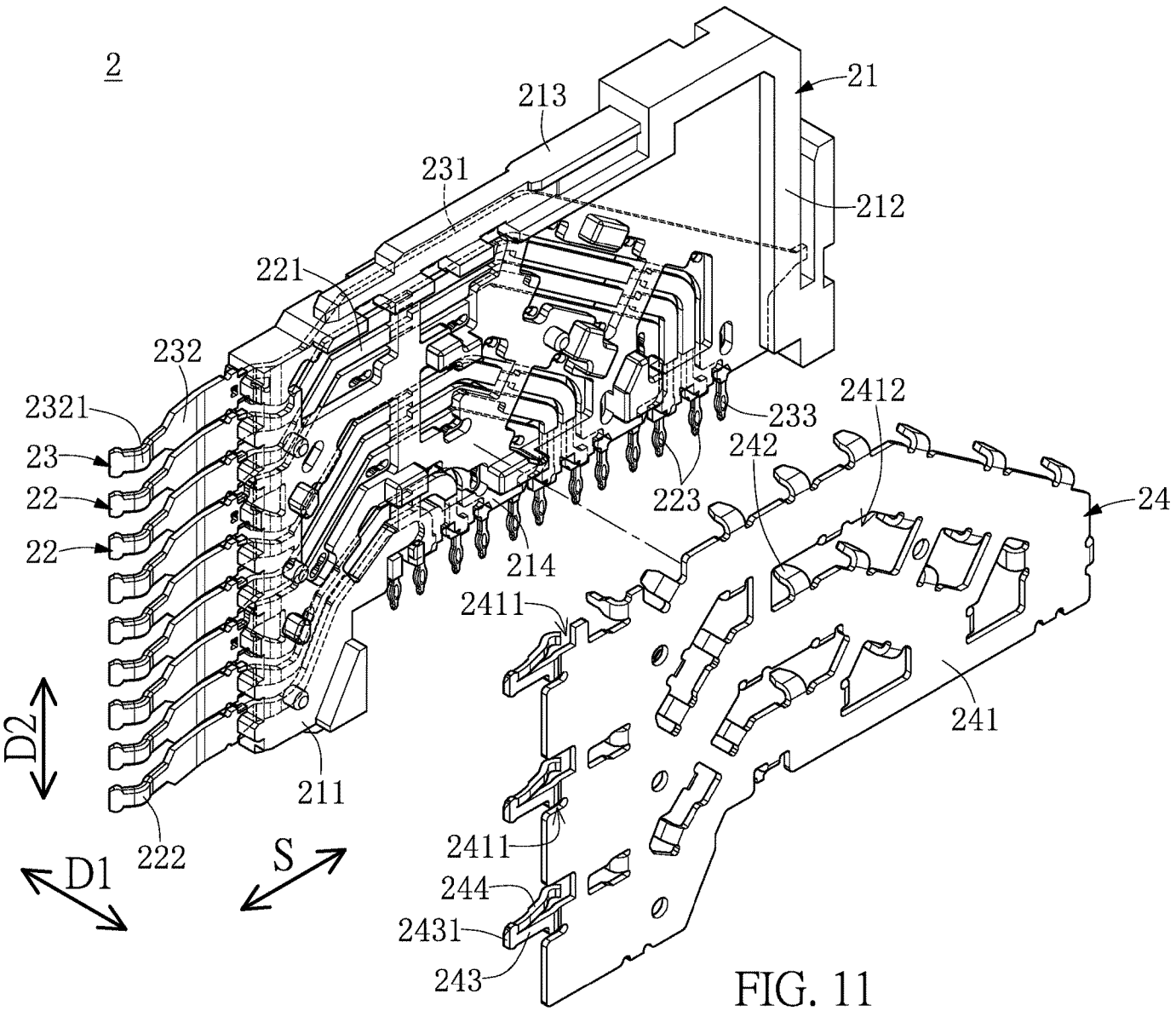
FIG. 11 is an exploded view of the transmission wafer according to the embodiment of the present disclosure.
Figure 12:
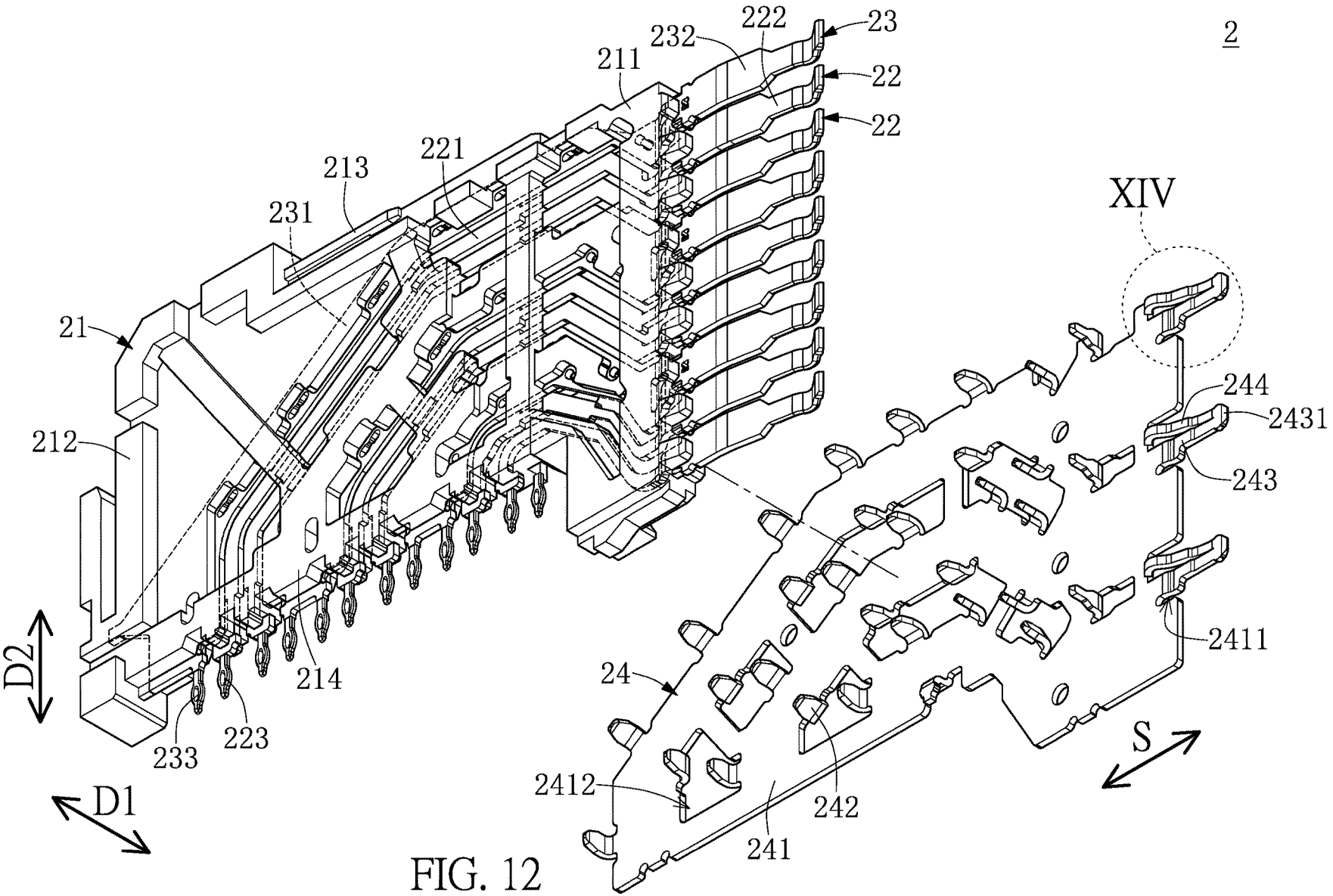
FIG. 12 is an exploded view of the transmission wafer according to the embodiment of the present disclosure from another angle of viewing.

As shown in FIG. 10 to FIG. 12, the transmission wafer 2 in the present embodiment includes an insulating frame 21 being in a substantially rectangular shape, a plurality of signal terminals 22 fixed to the insulating frame 21, a plurality of ground terminals 23 fixed to the insulating frame 21, and a shielding sheet 24 that is assembled to the insulating frame 21. The transmission wafer 2 is engaged with the positioning board 112 and the insertion portion 111 of the insulating outer case 11 through the insulating frame 21, and the ground terminals 23 and the shielding sheet 24 are connected to the conductive inner case 12.

The insulating frame 21 includes a front end portion 211, a rear end portion 212, a top end portion 213, and a bottom end portion 214, which are arranged on a peripheral portion thereof and each of which is in an elongated shape. A longitudinal direction of the front end portion 211 and a longitudinal direction of the rear end portion 212 are substantially parallel to the second direction D2, a longitudinal direction of the top end portion 213 and a longitudinal direction of the bottom end portion 214 are substantially parallel to the insertion direction S, and the longitudinal direction of the front end portion 211 is substantially perpendicular to the longitudinal direction of the bottom end portion 214.

Each of the signal terminals 22 is integrally formed as a signal one-piece structure, and includes a signal embedded segment 221 embedded in the insulating frame 21, a signal contacting segment 222 extending from the signal embedded segment 221 to protrude from (the front end portion 211 of) the insulating frame 21, and a signal assembling segment 223 that extends from the signal embedded segment 221 to protrude from (the bottom end portion 214 of) the insulating frame 21.

Moreover, in each of the signal terminals 22, the signal contacting segment 222 and the signal assembling segment 223 respectively extend from two opposite ends of the signal embedded segment 221, the signal contacting segment 222 substantially perpendicularly protrudes from the front end portion 211, and the signal assembling segment 223 substantially perpendicularly protrudes from the bottom end portion 214. In other words, a longitudinal direction of the signal contacting segment 222 and a longitudinal direction of the signal assembling segment 223 in the present embodiment substantially have an angle of 90 degrees, but the present disclosure is not limited thereto.

Each of the ground terminals 23 is integrally formed as a signal one-piece structure, and includes a ground embedded segment 231 embedded in the insulating frame 21, a ground contacting segment 232 extending from the ground embedded segment 231 to protrude from (the front end portion 211 of the insulating frame 21, and a ground assembling segment 233 that extends from the ground embedded segment 231 to protrude from (the bottom end portion 214 of) the insulating frame 21. Each of the ground contacting segments 232 has a ground contact 2321 that is used for contacting a grounding terminal 201 of the matching connector 200.

Moreover, in each of the ground terminals 23, the ground contacting segment 232 and the ground assembling segment 233 respectively extend from two opposite ends of the ground embedded segment 231, the ground contacting segment 232 substantially perpendicularly protrudes from the front end portion 211, and the ground assembling segment 233 substantially perpendicularly protrudes from the bottom end portion 214. In other words, a longitudinal direction of the ground contacting segment 232 and a longitudinal direction of the ground assembling segment 233 in the present embodiment substantially have an angle of 90 degrees, but the present disclosure is not limited thereto.

Specifically, the ground terminals 23 and the signal terminals 22 are staggeredly arranged, and a region between any two of the ground terminals 23 adjacent to each other (or a region adjacent to the any one of the ground terminals 23) can be provided with two of the signal terminals 22 (i.e., a differential pair) therein that are adjacent to each other for jointly transmitting a differential signal. The ground contacting segments 232 and the signal contacting segments 222 are arranged in one row along the second direction D2, and the ground assembling segments 233 and the signal assembling segments 223 are arranged in one row along the insertion direction S.

It should be noted that the ground embedded segment 231 and the signal embedded segment 221 are described by being embedded in the insulating frame 21, but any one of the ground embedded segment 231 and the signal embedded segment 221 can be partially exposed from the insulating frame 21 for adjusting the impedance of the transmission wafer 2. Moreover, a portion of the ground embedded segment 231 exposed from the insulating frame 21 can be provided for insertion and connection of the shielding sheet 24.

The shielding sheet 24 in the present embodiment is a signal one-piece structure formed by punching one metal sheet. The shielding sheet 24 includes a sheet body 241, a plurality of inner connecting arms 242 curvedly extending from the sheet body 241, a plurality of outer fixing arms 243 extending from the sheet body 241, and a plurality of elastic arms 244 that respectively extend from the outer fixing arms 243 toward the sheet body 241, but the present disclosure is not limited thereto. For example, in other embodiments of the present disclosure, the shielding sheet 24 can be provided without the inner connecting arms 242 and/or the elastic arms 244.

In the present embodiment, the sheet body 241 has a plurality of edge notches 2411 arranged on a front edge thereof and a plurality of inner notches 2412 that are arranged on an inner portion thereof. The inner connecting arms 242 substantially perpendicularly extend from inner walls of the inner notches 2412 and a top edge of the sheet body 241 toward the same side, and the outer fixing arms 243 respectively extend from inner walls of the edge notches 2411 (substantially along the insertion direction S). Each of the elastic arms 244 is a cantilever, and the elastic arms 244 respectively correspond in position to the edge notches 2411 along the first direction D1. Specifically, the elastic arms 244 substantially slantingly bend and extend from the outer fixing arms 243 toward the edge notches 2411 along the first direction D1 or along a plane defined by the first direction D1 and the insertion direction S, and the elastic arms 244 and the inner connecting arms 242 are arranged at the same side of the sheet body 241.

In the present embodiment, the sheet body 241 of the shielding sheet 24 is fixed to and riveted on one side of the insulating frame 21, so that the sheet body 241 can cover the signal embedded segments 221 of the signal terminals 22 along the first direction D1 for providing a complete signal shielding effect. The inner connecting arms 242 are respectively inserted into the ground embedded segments 231 of the ground terminals 23 (e.g., portions of the ground embedded segments 231 exposed from the insulating frame 21), so that the shielding sheet 24 and the ground terminals 23 can be commonly grounded.

Moreover, the outer fixing arms 243 are arranged in another row along the second direction D2, and the row of the outer fixing arms 243 is spaced apart from the row of the ground contacting segments 232 and the signal contacting segments 222. A quantity of the outer fixing arms 243 of the shielding sheet 24 is less than or equal to a quantity of the ground terminals 23, therefore, in any one of the transmission wafers 2, a quantity of the outer fixing arms 243 is less than or equal to a quantity of the ground terminals 23. In one of the transmission wafers 2 of the present embodiment, a quantity of the outer fixing arms 243 of the shielding sheet 24 is equal to a quantity of the ground terminals 23. Moreover, each of the outer fixing arms 243 and the corresponding elastic arm 244 jointly correspond in position to one of the ground contacting segments 232 along the first direction D1, and a connection part 245 of each of the outer fixing arms 243 and the corresponding elastic arm 244 is arranged outside of (or protrudes beyond) the ground contact 2321 of the corresponding ground contacting segment 232 (e.g., a bending edge of the ground contacting segment 232 shown in FIG. 13).

Specifically, in order to provide each of the outer fixing arms 243 having a better structural strength for fixing and effectively supporting the swing of the corresponding elastic arm 244, each of the outer fixing arms 243 in the present embodiment is formed with the following structural design, but the present disclosure is not limited thereto.

Figure 13:
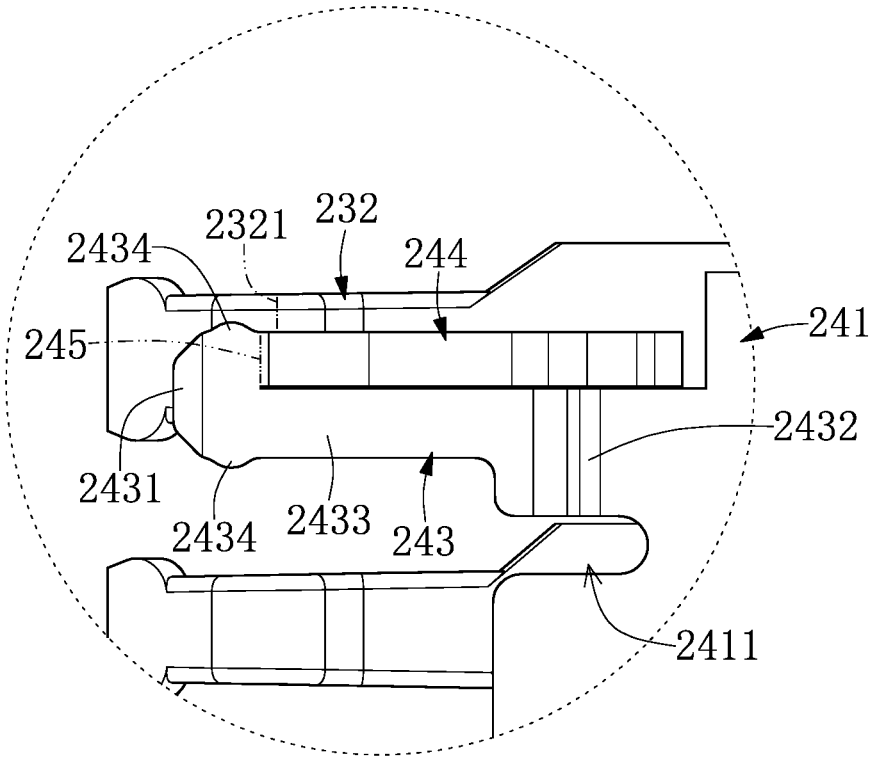
FIG. 13 is an enlarged view showing portion XIII of FIG. 10.
Figure 14:
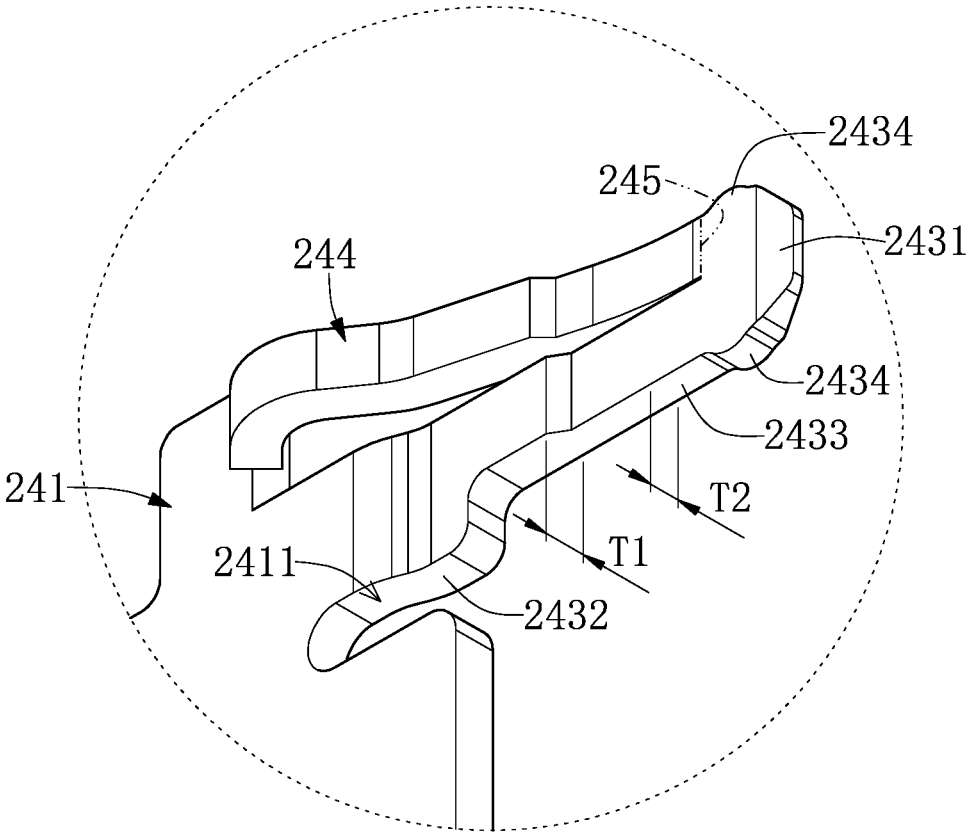
FIG. 14 is an enlarged view showing portion XIV of FIG. 12.

As shown in FIG. 11, FIG. 13, and FIG. 14, each of the outer fixing arms 243 includes a free end portion 2431 arranged away from the sheet body 241, a supporting portion 2432 connected to (the inner wall of the corresponding edge notch 2411 of) the sheet body 241, and a connecting portion 2433 that connects the supporting portion 2432 and the free end portion 2431. In each of the outer fixing arms 243 of the present embodiment, a first thickness T1 of the supporting portion 2432 in the first direction D1 is greater than a second thickness T2 of the connecting portion 2433 (or the free end portion 2431) in the first direction D1. A ratio defined by dividing the first thickness T1 to the second thickness T2 is preferable within a range from 1.1 to 1.5, but the present disclosure is not limited thereto.

Each of the elastic arms 244 in the present embodiment extends from the free end portion 2431 of the corresponding outer fixing arm 243, and is arranged adjacent to the connecting portion 2433 and the supporting portion 2432 of the corresponding outer fixing arm 243 (in the second direction D2). In other words, a lateral edge of the free end portion 2431 of each of the outer fixing arms 243 is connected to the connecting portion 2433 and the corresponding elastic arm 244.

The free end portion 2431 of each of the outer fixing arms 243 has two interference regions 2434 respectively arranged adjacent to the connecting portion 2433 and the corresponding elastic arm 244 and arranged on two opposite sides thereof, but the present disclosure is not limited thereto. For example, the outer fixing arm 243 (or the free end portion 2431) can have at least one interference region 2434. When each of the outer fixing arms 243 is inserted into the conductive inner case 12 through the free end portion 2431 thereof, the two interference regions 2434 enable the outer fixing arm 243 to be firmly fixed in the conductive inner case 12. Moreover, in each of the outer fixing arms 243, a maximum distance between the two interference regions 2434 of the free end portion 2431 is greater than a length of the lateral edge of the free end portion 2431 (that is connected to the connecting portion 2433 and the corresponding elastic arm 244).

Furthermore, the free end portion 2431 of each of the outer fixing arms 243 protrudes beyond the ground contact 2321 of the corresponding ground contacting segment 232 along the insertion direction S, and does not protrude beyond a distal end of the corresponding ground contacting segment 232 along the insertion direction S. In the present embodiment, the free end portion 2431 of each of the outer fixing arms 243 preferably protrudes beyond the ground contact 2321 of the corresponding ground contacting segment 232 along the insertion direction S by at least 0.5 mm, but the present disclosure is not limited thereto.

Accordingly, the transmission wafer 2 of the present embodiment is provided in a new structure different from conventional transmission wafers (e.g., the ground contacting segments 232 and the signal contacting segments 222 are arranged in one row, and the outer fixing arms 243 are arranged in another row; each of the free end portions 2431 protrudes beyond the corresponding ground contact 2321; the connection part 245 of each of the outer fixing arms 243 and the corresponding elastic arm 244 protrudes beyond the corresponding ground contact 2321; and a space is formed between the free end portion 2431 of each of the outer fixing arms 243 and the ground contact 2321 of the corresponding ground contacting segment 232 and a space is formed between the elastic arms 244 and the corresponding ground contacting segment 232), thereby expanding space in the follow-up research and design of the transmission wafer 2.

The above description describes the structure of one of the transmission wafers 2 of the present disclosure, but the specific structure of the transmission wafer 2 can be changed or adjusted according to design requirements and is not limited to the present embodiment. The following description describes the connection relationship between the transmission wafers 2 and the housing 1 of the present embodiment.

As shown in FIG. 4 to FIG. 7, the signal contacting segments 222 and the ground contacting segments 232 of the transmission wafers 2 are respectively inserted into and arranged in the terminal slots 1113 of the housing 1 along the insertion direction S, and the outer fixing arms 243 of the transmission wafers 2 are inserted into and fixed with the housing 1 through the free end portions 2431 thereof.

The ground contacts 232 and the free end portions 2431 of the transmission wafers 2 are electrically coupled to each other by being inserted into and fixed with the conductive inner case 12 (e.g., the free end portion 2431 of each of the outer fixing arms 243 is fixed to the conductive inner case 12 through the at least one interference region 2434 thereof), and the free end portion 2431 of each of the outer fixing arms 243 and the ground contact 2321 of the corresponding ground contacting segment 232 are spaced apart from each other along the first direction D1 by the conductive inner case 12. In other words, the free end portion 2431 of each of the outer fixing arms 243 is not in contact with the corresponding ground contacting segment 232.

Specifically, (the free end portions 2431 of) the outer fixing arms 243 and the ground contacting segments 232 of the transmission wafers 2 are inserted into and fixed with the connection surface 1221 of the conductive inner case 12 so as to be electrically coupled to each other. In the present embodiment, the outer fixing arms 243 of the transmission wafers 2 are respectively inserted into and fixed with the connection slots 1222 (e.g., each of the outer fixing arms 243 is fixed in the corresponding connection slot 1222 through the interference regions 2434 thereof), and each of the elastic arms 244 is arranged in one of the connection slots 1222 and the corresponding communication opening 1223. In more detail, an end of each of the elastic arms 244 adjacent to the connecting portion 2433 of the corresponding outer fixing arm 243 is arranged in one of the connection slot 1222, and another end of each of the elastic arms 244 adjacent to the supporting portion 2432 of the corresponding outer fixing arm 243 is exposed from the connection surface 1221 of the conductive inner case 12, but the present disclosure is not limited thereto. Furthermore, the connection part 245 is in a position between the end of the elastic arm 244 adjacent to the connecting portion 2433 of the corresponding outer fixing arm 243 and the corresponding outer fixing arm 243 connected thereto.

Accordingly, the electrical connector 100 of the present embodiment is provided in a new structure different from conventional electrical connectors (e.g., the connection surface 1221 of the conductive inner case 12 and the inner assembling surface 1112 of the insulating outer case 11 can be formed with the step difference G therebetween; and the ground contacting segments 232 and the outer fixing arms 243 of the electrical connector 100 are inserted into and fixed with the connection surface 1221), thereby expanding space in the follow-up research and design of the electrical connector 100.

Moreover, in the electrical connector 100 of the present embodiment, all grounding components (e.g., the ground terminals 23 and the shielding sheets 24) can be electrically coupled to each other through the conductive inner case 12, so that all of the grounding components and/or the communication wafers 2 can be commonly grounded for effectively preventing the signal terminals 22 from being interfered with external signal.

In other words, two of the signal contacting segments 222 of any one of the transmission wafers 2 adjacent to each other in the present embodiment are arranged in one of the exposed regions 1115 and are arranged in one of the windows 121 of the conductive inner case 12, and are surrounded from the corresponding window 121 in a plane perpendicular to the insertion direction S at least 180 degrees. Specifically, two of the signal contacting segments 222 of any one of the transmission wafers 2 adjacent to each other are surrounded from the corresponding enclosed window 1211 in the plane by 360 degrees or are surrounded from the corresponding open window 1211 in the plane by at least 180 degrees. Furthermore, two of the signal contacting segments 222 of any one of the transmission wafers 2 adjacent to each other are surrounded from at least two adjacent planes, in which one of the at least two adjacent planes is defined by the first direction D1 and the insertion direction S, and another one of the at least two adjacent planes is defined by the second direction D2 and the insertion direction S. In other words, at least two adjacent planes are defined by the vertical framepieces and the horizontal framepieces, such as the exposed portion 122 and the embedded portion 123. Accordingly, the performance of signal transmission of the signal terminals 22 of the electrical connector 100 can be increased by the arrangement of the windows 121 of the conductive inner case 12 and the signal terminals 22.

One of the windows 121 (e.g., the enclosed window 1211) can be formed to receive two of the signal contacting segments 222 of any one of the transmission wafers 2 adjacent to each other (i.e., a differential pair), or can be formed to receive ground contacting segment 232 and the adjacent signal contacting segment 222 of any one of the transmission wafers 2. Moreover, one of the windows 121 (e.g., the open window 1212) can be formed to just receive one of the ground contacting segments 232, or can be formed to just receive two of the signal terminals 22 (i.e., a differential pair). Any one of the signal terminals 22 can have a better shielding effect and a better performance of signal transmission by using the signal contacting segment 222 thereof to be arranged in the enclosed window 1211 or the open window 1212.

As shown in FIG. 2 and FIG. 4 to FIG. 7, when the electrical connector 100 of the present embodiment is connected to the matching connector 200, each of the grounding terminals 201 of the matching connector 200 is inserted into one of the terminal slots 1113 of the housing 1 that receives the corresponding ground terminal 23, and is inserted into a space between the corresponding ground terminal 23 and the corresponding window 121 of the conductive inner case 12, and/or is inserted into the space between the free end portion 2431 of each of the outer fixing arms 243 and the ground contact 2321 of the corresponding ground contacting segment 232, and/or is inserted into the space between the elastic arms 244 and the corresponding ground contacting segment 232. Moreover, end portions of the grounding terminals 201 pass through the conductive inner case 12 and are exposed from the connection surface 1221, each of the grounding terminals 201 is electrically coupled to a corresponding portion of the conductive inner case 12 (or the corresponding window 121), and each of the elastic arms 244 and the ground contact 2321 of the corresponding ground contacting segment 232 are abutted against one of the grounding terminals 201 of the matching connector 200 so as to be electrically coupled to each other. In the present embodiment, any one of the elastic arms 244 and the corresponding ground contacting segment 232 are abutted against and press onto (e.g., clamp) the corresponding grounding terminal 201 of the matching connector 200 in different directions. When each of the elastic arms 244 is abutted against the corresponding grounding terminal 201 of the matching connector 200, the elastic arm 244 swings toward the corresponding edge notch 2411 (shown in FIG. 11).

In the present embodiment, the ground terminals 23 and the shielding sheets 24 of the electrical connector 100 can be electrically coupled to each other and commonly grounded through the conductive inner case 12, and can be further connected to the matching connector 200 (e.g., each of the elastic arms 244 and the corresponding ground contact 2321 are abutted against one of the grounding terminals 201 of the matching connector 200), so that the grounding terminals 201 of the matching connector 200 can be electrically coupled to each other through the conductive inner case 12. Accordingly, the elastic arms 244, the ground contacts 2321, the grounding terminals 201, and the conductive inner case 12 are commonly grounded to achieve a common ground effect of all grounding components of the electrical connector 100 and the matching connector 200, thereby effectively ensuring the quality and efficiency of signal transmission.

In conclusion, any one of the transmission wafers of the present embodiment is provided in a new structure different from conventional transmission wafers (e.g., the ground contacting segments and the signal contacting segments are arranged in one row, and the outer fixing arms of the shielding sheet are arranged in another row; each of the free end portions protrudes beyond the corresponding ground contact; and the connection part of each of the outer fixing arms and the corresponding elastic arm protrudes beyond the corresponding ground contact), thereby expanding space in the follow-up research and design of the electrical connector (or the transmission wafer).

Specifically, the electrical connector of the present embodiment is also provided in a new structure different from conventional electrical connectors (e.g., the connection surface of the conductive inner case and the inner assembling surface of the insulating outer case can be formed with the step difference therebetween; and the ground contacting segments and the outer fixing arms of the electrical connector are inserted into and fixed with the connection surface), thereby expanding space in the follow-up research and design of the electrical connector.

Moreover, in the electrical connector of the present embodiment, all grounding components (e.g., the ground terminals and the shielding sheets) can be electrically coupled to each other through the conductive inner case, so that all of the grounding components and/or the communication wafers can be commonly grounded for effectively preventing the signal terminals from being interfered with by an external signal.

In addition, the ground terminals and the shielding sheets of the electrical connector in the present embodiment can be electrically coupled to each other and commonly grounded through the conductive inner case, and can be further connected to the matching connector (e.g., each of the elastic arms and the corresponding ground contact are abutted against one of the grounding terminals of the matching connector), so that the grounding terminals of the matching connector can be electrically coupled to each other through the conductive inner case. Accordingly, the elastic arms, the ground contacts, the grounding terminals, and the conductive inner case are commonly grounded to achieve a common ground effect of all grounding components of the electrical connector and the matching connector, thereby effectively ensuring the quality and efficiency of signal transmission.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector, comprising:

a housing including an insulating outer case and a conductive inner case that is disposed in the insulating outer case, wherein the insulating outer case has a plurality of terminal slots penetrating therethrough along an insertion direction; and a plurality of transmission wafers arranged along a first direction perpendicular to the insertion direction and inserted into the housing, wherein any one of the transmission wafers includes:

an insulating frame;

a plurality of signal terminals each including a signal embedded segment embedded in the insulating frame and a signal contacting segment that extends from the signal embedded segment to protrude from the insulating frame;

a plurality of ground terminals each including a ground embedded segment embedded in the insulating frame and a ground contacting segment that extends from the ground embedded segment to protrude from the insulating frame, wherein each of the ground contacting segments has a ground contact, and the ground contacting segments and the signal contacting segments are arranged in one row along a second direction that is perpendicular to the insertion direction and the first direction; and a shielding sheet assembled to the insulating frame and including a sheet body and a plurality of outer fixing arms that extend from the sheet body, wherein the outer fixing arms are arranged in another row along the second direction, and each of the outer fixing arms corresponds in position to one of the ground contacting segments along the first direction, and wherein a free end portion of each of the outer fixing arms protrudes beyond the ground contact of the corresponding ground contacting segment along the insertion direction, and each of the outer fixing arms and the corresponding ground contacting segment are inserted into and fixed with the conductive inner case;

wherein the signal contacting segments and the ground contacting segments of the transmission wafers are respectively arranged in the terminal slots of the housing.

2. The electrical connector according to claim 1, wherein the free end portion of each of the outer fixing arms protrudes beyond the ground contact of the corresponding ground contacting segment along the insertion direction by at least 0.5 mm.

3. The electrical connector according to claim 1, wherein the free end portions of the outer fixing arms of the transmission wafers are inserted into and fixed with the conductive inner case.

4. The electrical connector according to claim 1, wherein the ground contacts and the free end portions of the outer fixing arms of the transmission wafers are electrically coupled to each other by being inserted into and fixed with the conductive inner case.

5. The electrical connector according to claim 1, wherein the conductive inner case is an electro-plated plastic inner case, a conductive plastic inner case, or a metallic inner case.

6. The electrical connector according to claim 1, wherein the free end portion of each of the outer fixing arms and the ground contact of the corresponding ground contacting segment are spaced apart from each other along the first direction by the conductive inner case.

7. The electrical connector according to claim 1, wherein the insulating outer case has an outer matching surface and an inner assembling surface, and the terminal slots are formed by penetrating from the outer matching surface to the inner assembling surface, wherein the conductive inner case has a connection surface arranged away from the outer matching surface, the free end portions of the outer fixing arms and the ground contacting segments of the transmission wafers are inserted into and fixed with the connection surface of the conductive inner case so as to be electrically coupled to each other, and the connection surface and the inner assembling surface have a step difference therebetween along the insertion direction.

8. The electrical connector according to claim 1, wherein the conductive inner case has a plurality of windows in spatial communication with the terminal slots, and a quantity of the windows is less than a quantity of the terminal slots, and wherein, in any one of the transmission wafers, two of the signal contacting segments adjacent to each other are arranged in one of the windows of the conductive inner case.

9. The electrical connector according to claim 1, wherein, in any one of the transmission wafers, a quantity of the outer fixing arms of the shielding sheet is equal to a quantity of the ground terminals, and the free end portion of each of the outer fixing arms does not protrude beyond a distal end of the corresponding ground contacting segment along the insertion direction.

10. The electrical connector according to claim 1, wherein the free end portion of each of the outer fixing arms has at least one interference region, and the free end portion of each of the outer fixing arms is fixed to the conductive inner case through the at least one interference region thereof.

11. The electrical connector according to claim 1, wherein, in any one of the transmission wafers, the shielding sheet has a plurality of elastic arms that respectively extend from the outer fixing arms toward the sheet body, each of the outer fixing arms and the corresponding elastic arm jointly correspond in position to one of the ground contacting segments along the first direction, and a connection part of each of the outer fixing arms and the corresponding elastic arm is arranged outside of or protrudes beyond the ground contact of the corresponding ground contacting segment.

12. The electrical connector according to claim 1, wherein the conductive inner case has a connection surface arranged away from the insulating outer case and a plurality of connection slots that are recessed therein and that are electrically coupled to each other, and wherein the connection slots are spaced apart from each other, and the outer fixing arms of the transmission wafers are respectively inserted into and fixed with the connection slots.

13. The electrical connector according to claim 12, wherein, in any one of the transmission wafers, the shielding sheet has a plurality of elastic arms that respectively extend from the outer fixing arms toward the sheet body, an end of each of the elastic arms adjacent to the free end portion of the corresponding outer fixing arm is arranged in one of the connection slots, and another end of each of the elastic arms away from the free end portion of the corresponding outer fixing arm is exposed from the connection surface of the conductive inner case.

14. The electrical connector according to claim 1, wherein each of the outer fixing arms has a supporting portion connected to the sheet body and a connecting portion that connects the supporting portion and the free end portion, a first thickness of the supporting portion in the first direction is greater than a second thickness of the connecting portion or the free end portion in the first direction.

15. A transmission wafer of an electrical connector, comprising:

an insulating frame;

a plurality of signal terminals each including a signal embedded segment embedded in the insulating frame and a signal contacting segment that extends from the signal embedded segment to protrude from the insulating frame;

a plurality of ground terminals each including a ground embedded segment embedded in the insulating frame and a ground contacting segment that extends from the ground embedded segment to protrude from the insulating frame, wherein each of the ground contacting segments has a ground contact; and a shielding sheet assembled to the insulating frame and including a sheet body and a plurality of outer fixing arms that extend from the sheet body, wherein each of the outer fixing arms corresponds in position to one of the ground contacting segments along a first direction;

wherein the ground contacting segments and the signal contacting segments are arranged in one row along a second direction that is perpendicular to the first direction, and the outer fixing arms are arranged in another row along the second direction, and wherein a free end portion of each of the outer fixing arms protrudes beyond the ground contact of the corresponding ground contacting segment along an insertion direction that is perpendicular to the first direction and the second direction.

16. The transmission wafer according to claim 15, wherein the free end portion of each of the outer fixing arms protrudes beyond the ground contact of the corresponding ground contacting segment along the insertion direction by at least 0.5 mm.

17. The transmission wafer according to claim 15, wherein a quantity of the outer fixing arms of the shielding sheet is equal to a quantity of the ground terminals, and the free end portion of each of the outer fixing arms does not protrude beyond a distal end of the corresponding ground contacting segment along the insertion direction.

18. The transmission wafer according to claim 15, wherein the free end portion of each of the outer fixing arms has at least one interference region, and the free end portion of each of the outer fixing arms is fixed to the conductive inner case through the at least one interference region thereof.

19. The transmission wafer according to claim 15, wherein the shielding sheet has a plurality of elastic arms that respectively extend from the outer fixing arms toward the sheet body, each of the outer fixing arms and the corresponding elastic arm jointly correspond in position to one of the ground contacting segments along the first direction, and a connection part of each of the outer fixing arms and the corresponding elastic arm is arranged outside of or protrudes beyond the ground contact of the corresponding ground contacting segment.

20. The transmission wafer according to claim 15, wherein each of the outer fixing arms has a supporting portion connected to the sheet body and a connecting portion that connects the supporting portion and the free end portion, a first thickness of the supporting portion in the first direction is greater than a second thickness of the connecting portion or the free end portion in the first direction.

* * * * *